US006079869A

United States Patent [19]

Kokk et al.

[11] Patent Number: 6,079,869

[45] Date of Patent: Jun. 27, 2000

[54] FLAGELLA DEVICE FOR MIXING OF VISCOUS SUBSTANCES

[76] Inventors: Mati Kokk, Gildi 3/11, Tartu, Estonia, EE2400; Kaile Köömnemägi, Vete 13, Tallinn, Estonia, EE0016; Jevgeni Rjazin, Tiligi 14, Tartu, Estonia, EE2400

[21] Appl. No.: 09/155,943

[22] PCT Filed: Feb. 9, 1998

[86] PCT No.: PCT/EE98/00001

§ 371 Date: Oct. 9, 1998

§ 102(e) Date: Oct. 9, 1998

[87] PCT Pub. No.: WO98/34720

PCT Pub. Date: Aug. 13, 1998

[30] Foreign Application Priority Data

Feb. 10, 1997 [EE] Estonia ..... 9700012

[51] Int. Cl.[7] ..... B01F 11/04

[52] U.S. Cl. ..... 366/241; 366/255; 366/108; 366/343

[58] Field of Search ..... 366/342, 346, 366/241, 247, 243, 255, 343, 345, 259, 276, 108, 114, 117, 118, 120, 122, 123, 128, 349

[56] References Cited

U.S. PATENT DOCUMENTS

| | | | |
|---|---|---|---|
| 2,174,348 | 9/1939 | Damond | 366/108 |
| 2,488,915 | 11/1949 | Jackson | 366/117 |
| 3,140,996 | 7/1964 | Scott | 366/117 |
| 3,202,402 | 8/1965 | Giertz-Hedstrom | 366/128 |
| 3,369,627 | 2/1968 | Schempf | 366/108 |
| 4,122,296 | 10/1978 | Hummer et al. | 366/346 |
| 4,207,005 | 6/1980 | Stanfield | 366/108 |
| 4,221,521 | 9/1980 | Kirwan | 366/120 |

FOREIGN PATENT DOCUMENTS

| | | | |
|---|---|---|---|
| 78005 | 8/1954 | Netherlands | 366/346 |
| 285566 | 3/1971 | U.S.S.R. | 366/117 |
| 197801 | 1/1978 | U.S.S.R. | 366/120 |
| 1017712 | 5/1983 | U.S.S.R. | 366/241 |
| 1025401 | 6/1983 | U.S.S.R. | 366/108 |

*Primary Examiner*—Tony G. Soohoo
*Attorney, Agent, or Firm*—James Creighton Wray; Meera P. Narasimhan

[57] ABSTRACT

Flagella device for mixing of viscose substances comprises elastic, flexible carrying beam containing an arc-shape channel, an airtight body-work surrounding the oscillating body and drive, interfaces connecting the carrying beam and the oscillating body, details joining the flagella device with the exterior construction, and the mechanisms arranging the mutual position of the device's components, and the device regulating their movement according to the tank's construction provides for an arcuate motion of the oscillating body which may reach the full extent of the tank.

24 Claims, 2 Drawing Sheets

FLAGELLA DEVICE FOR MIXING OF VISCOUS SUBSTANCES

BACKGROUND OF THE INVENTION

Invention has been designed for mixing of viscose substances, above all for faster and more efficient discharge of such substances from the tanks.

At present time different circulation methods are applied to discharge the tanks from substances of high viscosity, for example oil and oil products. At their application a hot substance is pumped from the nozzles settled in the middle of the tank to the surface of the substance kept in the tank, or the jets of heated substance are thrown to the surface layer of the substance, enabling to reduce the viscosity of substance so that the discharge of substance from tank is possible. The added hot substance warms up only the the surface layer of the substance placed in the tank and does not penetrate to the lower layers and therefore the applied methods and devices do not ensure the sufficient mix of the substances to the extent of the entire tank and the suitable condition of the substances for their discharge from the tank.

A device manufactured by a famous Finnish company JKV—Hydrauliikka OY based on the circulation method (analogue) for the discharge of tanks, first of all railroad tanks, consisting of a beam entered through the upper opening of the tank (carrying beam), to beams connected to it and the mechanism for their slope.

The shortcoming of the noted device is the limited moving ability of the entered beams in the tank that does not ensure the even warming up of the substance located in the tank, neither the availability to discharge it.

Noted is a device for the discharge of viscose substances from the railway tanks described in the book: H.B. Калашников В.И. Черникин "ВИБРОНОДОГРЕВ ВЯЗКИХ НЕФТЕПРОДУКТОВ" ГОСТОПТЕХИЗДАТ Москва 1961.

(Heating of Viscose Oil-products Applying Vibration") (prototype), consisting of carrying beam, an oscillating body connected to it, interfaces connecting them one to another, a drive that is in mutual connection with the oscillating body, details connecting the device to exterior construction, a mechanism organising the mutual position of the carrying beam, oscillating body and interfaces connecting them.

The shortcoming of the noted device is the necessity to fix it each time to the upper opening of the railway tank, that is time consuming and labour consuming and therefore extending the time for the discharge of substance from the tank. The projection of the lowered, oscillating bodies (beams of elliptic cross-section) on to the tank's longitudinal axle constitutes 50% of the tank's length, so the thermal exchange takes place in up to one/half of the tank's length. The intensive circulation of the hot substance occurs only in the nearest surrounding of the working oscillating bodies and in the levels passing them and crossing the tank's longitudinal axle. Therefore the areas of high viscosity substance remains in both ends of the tank, where the circulation is insufficient, or does not occur at all. Therefore the even warming up of the substance located in tank is not ensured, first of all at the ends of the tank where remain the so-called compact lumps. The discharge ability of the tankers does not exceed 85% that is related to the share of viscose substance remaining there. The share of the substance remaining in the tank reduces the tank's useful volume and in the transportation tanks the compacts lumps deposited there are carried there. This in turn increases the empty mass of the transportation unit.

SUMMARY OF THE INVENTION

The objective of this invention is to eliminate the aforementioned shortcomings. Extension of the compulsory convection between the colder substance of higher viscosity and this warmer and of lower viscosity flowing on its surface or sprayed on its surface in a form of jet, as well as the area of the occurrence of thermal exchange, and essential intensfying of compulsory convection, and subsequently the thermal exchange.

The objective of this invention shall be achieved so that the flagella device for mixing of viscose substances comprises a carrying beam, an oscillating body connected to it, interfaces connecting them one to another, a drive that is in mutual connection with the oscillating body, details connecting the device to exterior construction, a mechanism organising the mutual position of the carrying beam, oscillating body and interfaces connecting them. Carrying beam correspondents to the tank's construction, for example to the form of the circular line's arc, equipped with adjusting device and built of elastic material, plastic for example. It can be upon the necessity turned around the centre of the circular line. There is a channel in the carrying beam through which the necessary hot substance can be driven to the tank and the tank's inlet is located at the flagella device's work position away from the oscillating body and the outlet is located at the flagella device's work position near the oscillating body. The carrying beam and the oscillating body are connected by flexible interfaces. As device causing oscillation may be used an eccentric vibrator. Via the device regulating the movement of the carrying beam, oscillating body and the interfaces connecting them, their movement is determined between two parallel planes and two concentric spheres intersecting those planes so that the centre of spheres is located between the said planes in equal distance from them. The flexible connection interfaces are tubular and enable the energy transmission to the oscillating body. The oscillating body and its drive are surrounded by an airtight body-work excluding the dropping of viscose substance to drive. The details connecting device to exterior construction with the device regulating its movement, for what is used a hydro-cylinder, enable the movement of the flagella device itself to the full extent of the tank's upper part and as a result of the co-operation of all the above mentioned components, the oscillating body can be moved to the desired location in the tank in so doing ensuring the mixing of the substance to the full extent of tank.

BRIEF DESCRIPTION OF THE DRAWINGS

The invention is illustrated by drawing (see FIG. 1) where the flagella device is shown in initial position and drawing (see FIG. 2) in working position.

DETAILED DESCRIPTION OF THE PREFERRED EMBODIMENTS

Figure 1:
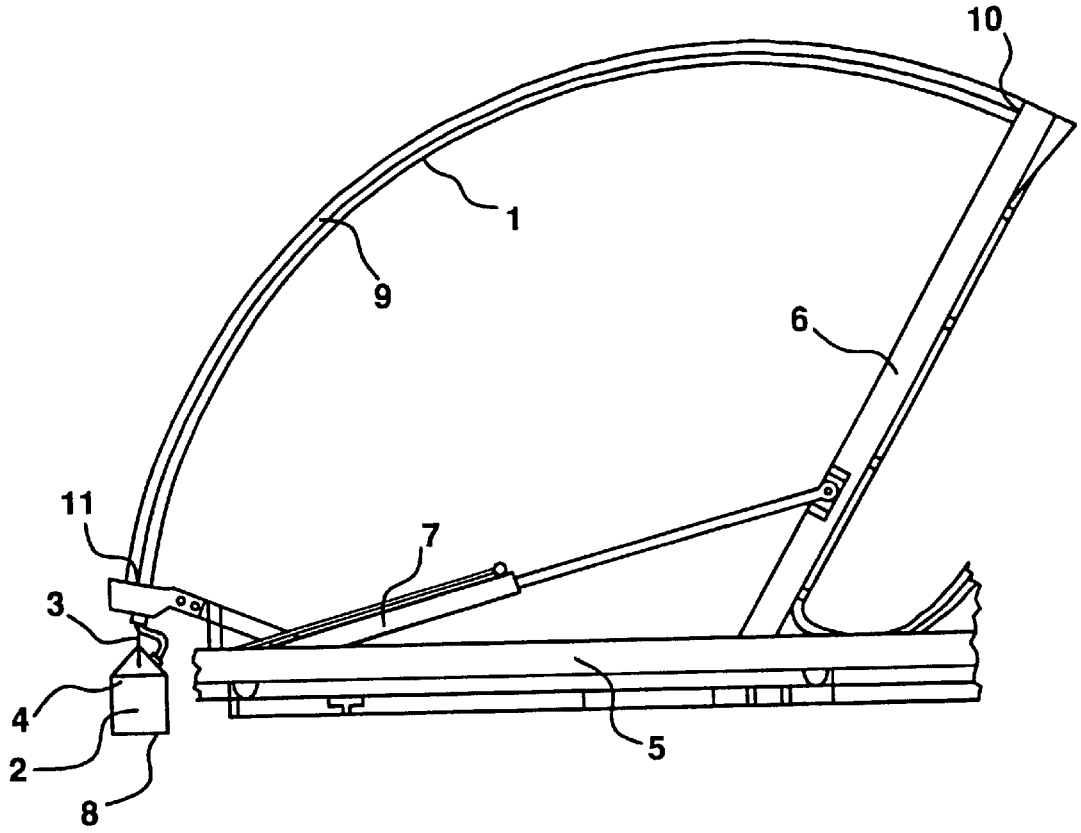

FIG. 1 shows the flagella device that contains a carrying beam (1) entered to the tank, with channel (9). Carrying beam (1) is connected by flexible interface (3) with oscillating body (2). The oscillating body (2) and drive (4) are surrounded by hermetic body-work (8). The carrying beam (1) is connected near its outlet (11) by a flexible interface (3) to oscillating body (2) and the inlet (10) is located in the other end of carrying beam (1). The device regulating movement (7) that can be a hydro-cylinder, is connected by a mechanism organising the mutual positions of the components (6) and to the arched carrying beam (1) located attached to the mechanism an oscillating body (2) has been fixed by blending connection interfaces (3). The organising mechanism (6) connects the flagella device to the details relating the exterior construction (5).

Flagella device for mixing of viscose substances works as follows.

Figure 2:
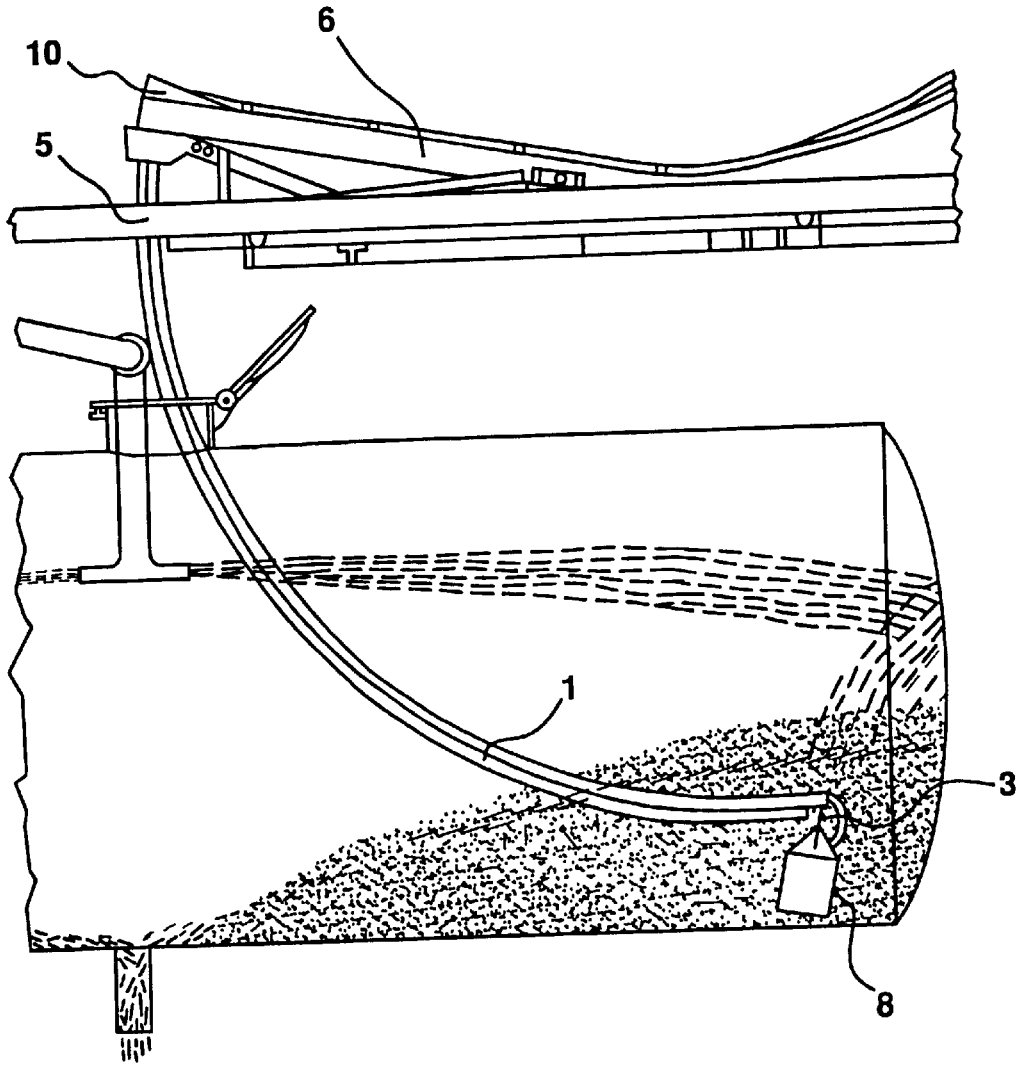

The oscillating body (2) surrounded by body-work (8) together with Its drive (4) is delivered with the help of arched carrying beam (1) to which they are fixed with flexible connection interfaces (3) above the tank's upper opening (see FIG. 1) Thereafter the arched carrying beam (1) together with oscillating body (2) hanging on it, is delivered by the force of gravity, device regulating movement (7), for example hydro-cylinder or force effected by other suitable factor, through the opening of the tank (see FIG. 2) into the substance placed in it. At that moment the drive (4) puts the oscillating body (2) into operation. By the operation of oscillating body (2) the mass and thermal exchange in the substance surrounding it intensifies essentially. For the further intensifying of the mass and thermal exchange process, the device regulating the movement of the flagella device's components (7) directs the oscillating body (2) stet-by-step to the thicker areas of the processed substance. As a result of this, the sufficient convection of the substance located in tank to its full extent is achieved. This ensures the warming up of the substance located in tank to such level that, thanks to reduced viscosity gained by increase of temperature, the faster discharge of the substance from tank is possible. Also are dissolved the so-called compact lumps and the entire discharge ability of the substance is achieved.

What is claimed is:

1. Apparatus for mixing viscous substances comprising at least one flagella having an arc-shaped boom, an oscillating body connected to the boom, at least one connector connecting the boom and the oscillating body, a drive connected to the oscillating body, supports for supporting the flagella, a positioning device connecting the supports and the boom for variably positioning the boom, the oscillating body and the at least one connector.

2. The apparatus of claim 1, further comprising a housing enclosing the oscillating body and the drive for protection during mixing of the substances.

3. The apparatus of claim 2, wherein the housing is hermetic.

4. The apparatus of claim 1, wherein the arc-shape is an arc of a curve.

5. The apparatus of claim 4, wherein the arc-shape is an arc of a circle.

6. The apparatus of claim 1, wherein the boom is elongatable.

7. The apparatus of claim 1, wherein the boom is telescopic.

8. The apparatus of claim 1, wherein the boom is of flexible material.

9. The apparatus of claim 8, wherein the material is plastic.

10. The apparatus of claim 1, wherein the boom is rotatable.

11. The apparatus of claim 1, further comprising an inlet and an outlet channel on the boom, wherein the inlet channel is proximal the positioning device and the outlet channel is proximal the oscillating body.

12. The apparatus of claim 1, wherein the oscillating body is a mechanical oscillator.

13. The apparatus of claim 1, wherein the oscillating body is a vibrator.

14. The apparatus of claim 1, wherein the at least one connector is flexible.

15. The apparatus of claim 1, further comprising plural connectors connecting the oscillating body and the boom.

16. The apparatus of claim 1, wherein the at least one connector is tubular for allowing energy transmission to the oscillating body.

17. The apparatus of claim 1, wherein the drive and the oscillating body are proximally located.

18. The apparatus of claim 1, wherein the positioning device has means for regulating movement of the boom, the oscillating body and the connector to various positions in a container carrying the viscous substances and for mixing of the substances entirely within the container.

19. The apparatus of claim 18, wherein the means is a hydraulically operable device.

20. The apparatus of claim 1, wherein the oscillating body, connector, and the boom are of non-corrosive and durable material.

21. The apparatus of claim 1, further comprising plural flagella for mixing the substances in a container.

22. A process for mixing viscous substances comprising providing an arc-shaped boom, oscillating a body connected to the boom in a container having the viscous substances, driving the oscillating body by a drive means, supporting the flagella on supports, variably positioning in the container the supports, the boom, and the oscillating body by positioning means.

23. The process of claim 22, wherein the variably positioning comprises regulating movement of the boom, the oscillating body and the connector to various positions in the container by regulating means and mixing the substances within the entire container.

24. The process of claim 23, wherein the regulating means is hydraulically operated.

* * * * *